US008397398B2

(12) United States Patent
Poloni

(10) Patent No.: US 8,397,398 B2
(45) Date of Patent: Mar. 19, 2013

(54) TEMPLATE FOR CENTERING ROLLERS AT THE FOOT OF AN INGOT MOLD

(75) Inventor: Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 248 days.

(21) Appl. No.: 12/737,686

(22) PCT Filed: Aug. 7, 2009

(86) PCT No.: PCT/IB2009/053471

§ 371 (c)(1),
(2), (4) Date: Feb. 7, 2011

(87) PCT Pub. No.: WO2010/016036

PCT Pub. Date: Feb. 11, 2010

(65) Prior Publication Data

US 2011/0126417 A1 Jun. 2, 2011

(30) Foreign Application Priority Data

Aug. 8, 2008 (IT) ..... MI2008A1503

(51) Int. Cl.
*G01D 21/00* (2006.01)
*B23P 6/00* (2006.01)
*B22D 11/20* (2006.01)

(52) U.S. Cl. ..... 33/644; 33/562

(58) Field of Classification Search ..... 33/644, 33/562, 520

See application file for complete search history.

(56) References Cited

U.S. PATENT DOCUMENTS

| | | | | |
|---|---|---|---|---|
| 1,448,528 | A * | 3/1923 | Elliot | 29/272 |
| 3,863,356 | A | 2/1975 | Bengel et al. | |
| 4,489,495 | A | 12/1984 | Scheinecker | |
| 4,711,037 | A * | 12/1987 | Saadat | 33/520 |
| 4,754,551 | A * | 7/1988 | Scott | 33/543 |
| 5,168,638 | A * | 12/1992 | Barton | 33/644 |
| 6,382,882 | B1 * | 5/2002 | Ouellette | 406/198 |
| 6,994,002 | B2 * | 2/2006 | Moruzzi | 82/123 |
| 7,765,703 | B2 * | 8/2010 | Buckus | 33/286 |
| 2002/0078584 | A1 * | 6/2002 | Segal et al. | 33/644 |

FOREIGN PATENT DOCUMENTS

| | | |
|---|---|---|
| EP | 0047919 | 3/1982 |
| FR | 2375935 | 7/1978 |
| JP | 49098333 | 9/1974 |
| JP | 51142012 | 11/1976 |

OTHER PUBLICATIONS

B. Debiesme, et al.; "Mise Au Point Du Systeme Misol"; Mar. 1, 1992; pp. 279-282; vol. 89, No. 3.

R. Fash et al.; "Dynamic Machine Gap Control At the ISG Sparrows Point No. 1 Caster"; May 1, 2005; pp. 229-241; vol. 2, No. 5.

* cited by examiner

*Primary Examiner* — Christopher Fulton

(74) *Attorney, Agent, or Firm* — Stetina Brunda Garred & Brucker

(57) ABSTRACT

A template for centering the rollers at the foot of an ingot mold which allows a quick and accurate centering of said rollers, regardless of the operator's skill and experience. There is also described a corresponding method for centering the rollers at the foot of an ingot mold.

15 Claims, 4 Drawing Sheets

C-C

C'-C'

TEMPLATE FOR CENTERING ROLLERS AT THE FOOT OF AN INGOT MOLD

FIELD OF THE INVENTION

The present invention refers to a template for centering rollers at the foot of an ingot mold.

BACKGROUND ART

Presently, for centering the rollers at the foot of an ingot mold, the operator performs a series of manual operations for adjusting the position of the rollers by using a monolithic template designed to be adapted and secured by means of shims or spacers to the inner walls of the crystallizer, housed inside the ingot mold body, such that it follows the tapers existing in the walls of the crystallizer.

In particular, the operator first aligns the intrados rollers by means of the spacers and the template, and then repeats the same operation for the extrados rollers and the side rollers. If necessary, the centering is completed by adjusting the position of the rollers at other sides of the crystallizer, as in the case of a quadrangular section.

The afore-mentioned manual operations of centering by using this monolithic template disadvantageously require long times, and the centering effectiveness is however highly related to the operator's experience and skills.

It is therefore felt a need for implementing a template for centering the rollers at the foot of an ingot mold that allows to overcome the afore-mentioned drawbacks.

SUMMARY OF THE INVENTION

It is the primary object of the present invention to implement a template for centering the rollers at the foot of an ingot mold that allows a quick and accurate centering of said rollers, regardless of the operator's skill and experience, ensuring the centering repeatability.

It is another object of the invention to implement a template that may self-adapt to the taper of the inner walls of the crystallizer.

It is a further object of the invention to provide a corresponding method for centering the rollers at the foot of an ingot mold which may be easily performed with accuracy even by less-experienced operators.

Therefore, the present invention aims at achieving the above-discussed objects by implementing a template for centering the rollers at the foot of an ingot mold, the ingot mold being provided with a crystallizer in which the template may be inserted by passing therethrough from a first end to a second end, the template, in accordance with the device as disclosed, defining a longitudinal axis and comprising:

at least two longitudinal elements, separated from each other, having an outer surface of a shape substantially complementary with respective inner wall portions of the crystallizer;

at least one expansible means, housed inside the template and at least partially covering the longitudinal extension of a length of template adapted to remain inside the crystallizer when the template is inserted into said crystallizer, said at least one expansible means being adapted to expand so as to adhere said longitudinal elements to said respective wall portions.

A second aspect of the present invention provides for a method for centering the rollers at the foot of an ingot mold, provided with a crystallizer, by using the aforementioned template, which in accordance with the method as disclosed comprises the following steps:

a) inserting the template into the crystallizer;

b) expanding the at least one expansible means, whereby a contact is made between the longitudinal elements of the template and the inner walls of the crystallizer;

c) centering the rollers at the foot by approaching the rollers until reaching a position of first contact of said rollers along one generatrix thereof with said longitudinal elements.

Advantageously, besides allowing to facilitate and significantly reduce the duration of the centering operation, the device and method of the invention allow to avoid possible problems during the continuous casting process by the virtue of the high centering accuracy achieved and, therefore, of the high accuracy in guiding the cast product.

Providing for appropriately shaped striking planes on the template, such that they perfectly follow the inner tapers of the crystallizer, further improves the centering accuracy and the repeatability of the obtained result.

The template, object of the present invention, may be implemented so as to be inserted into a crystallizer which may have different shapes, e.g. a quadrangular section, for casting blooms or billets, or a round section.

The expansible means, housed inside the template, may comprise at least one air chamber or other suitable devices being similar or having similar functions.

An embodiment of the template of the invention provides for expansible means therein, which comprise only one air chamber at least partially covering the longitudinal extension of the length of template which is kept within the crystallizer.

A further embodiment of the template of the invention provides for expansible means therein, which comprise two air chambers arranged in positions corresponding to the upper and lower ends, respectively, of the crystallizer in which the template is inserted.

Other embodiments may provide for the use of air chambers in a number exceeding two.

The dependent claims describe preferred embodiments of the invention.

BRIEF DESCRIPTION OF THE DRAWINGS

Further features and advantages of the invention will be more evident in view of the detailed description of a preferred, but not exclusive, embodiment of a template for centering the rollers at the foot of an ingot mold, by way of non-limiting example, with the aid of the accompanying drawings, in which.

DETAILED DESCRIPTION OF A PREFERRED EMBODIMENT OF THE INVENTION

Figure 1:
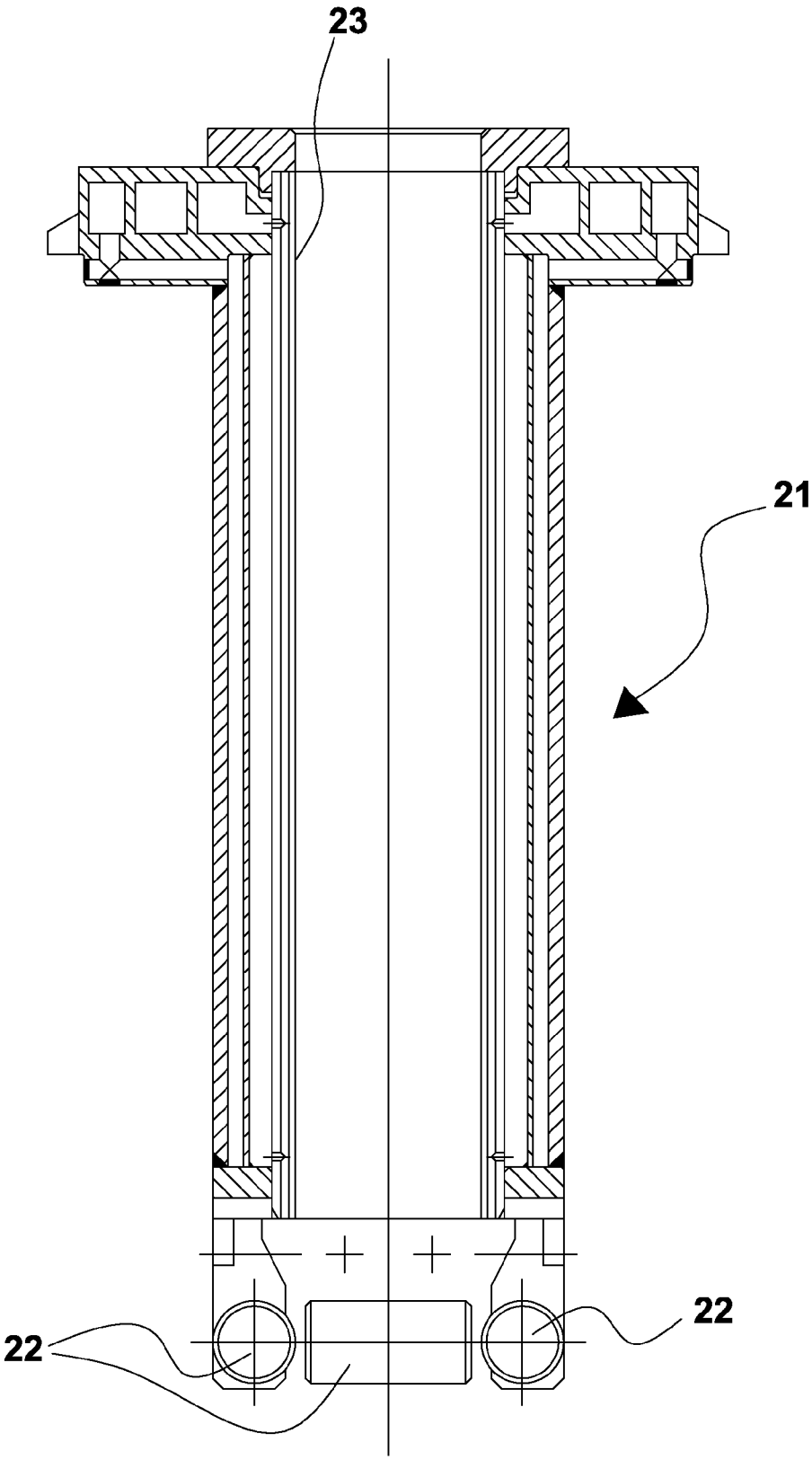
FIG. 1 depicts an example of a part of an ingot mold provided with rollers at the foot and a crystallizer.

With reference to Figures from 2 to 7, there is depicted a first embodiment of a centering template 1 for centering the rollers at the foot of an ingot mold. The template 1, object of the present invention, defines a longitudinal axis X and is suitable for being housed inside a crystallizer having a quadrangular shape for casting blooms or billets. FIG. 1 shows, by way of example, a portion of an ingot mold 21 provided with rollers at the foot 22 and a crystallizer 23.

In this first embodiment, the template 1 comprises four longitudinal elements 4, also named tiles, which are separated from one another.

Figure 3:
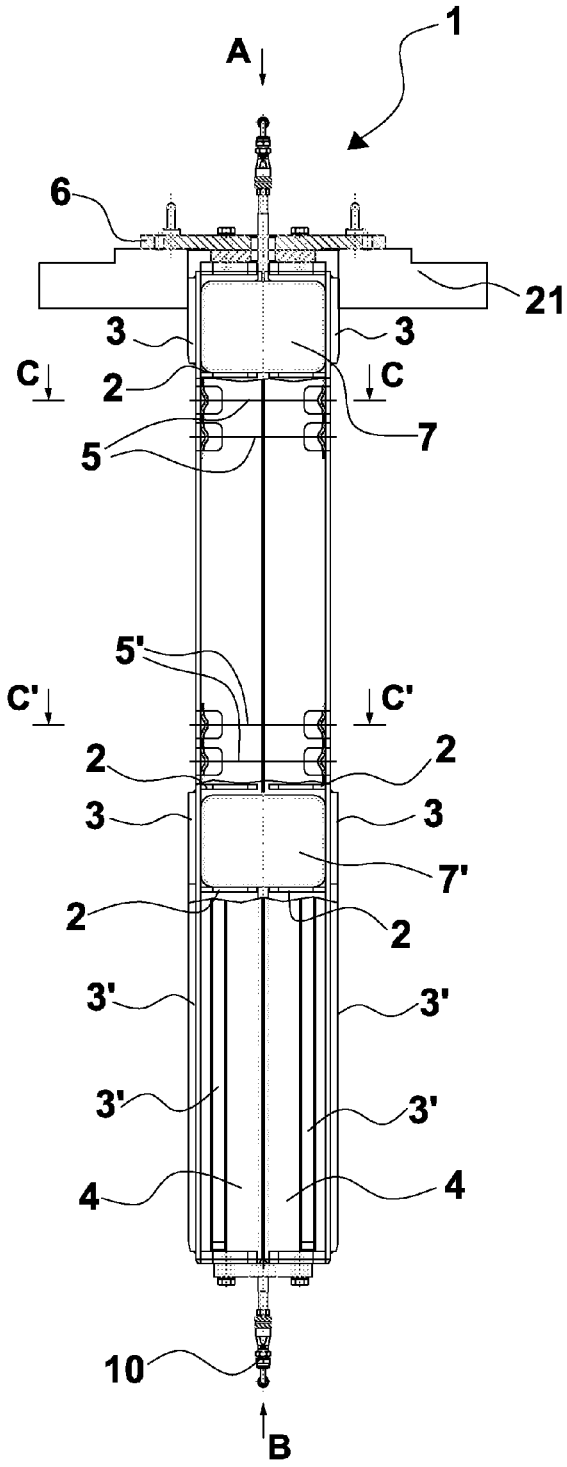
FIG. 3 depicts a second partially cut-out side view of a centering template according to the invention.
Figure 4:
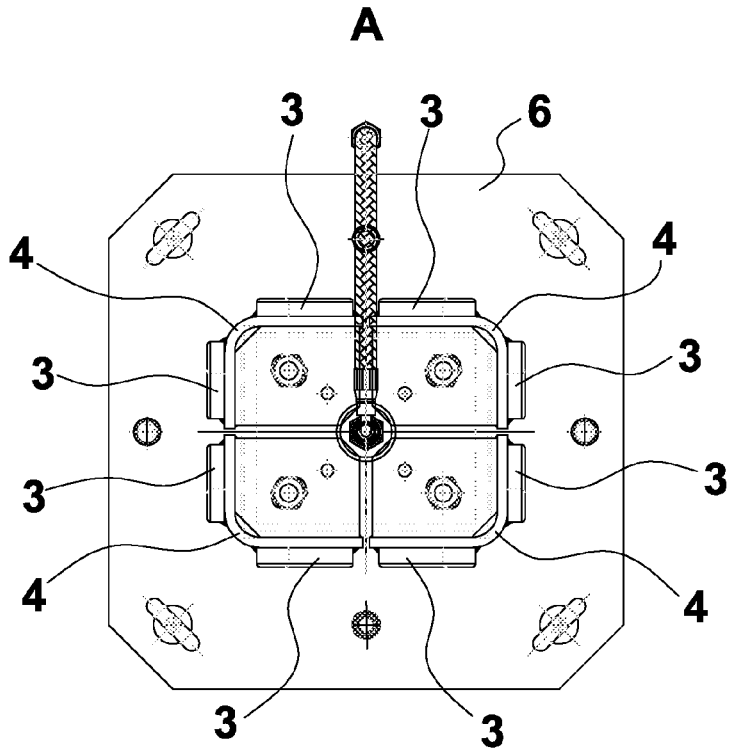
FIG. 4 depicts a top view of the template in FIG. 2.
Figure 5:
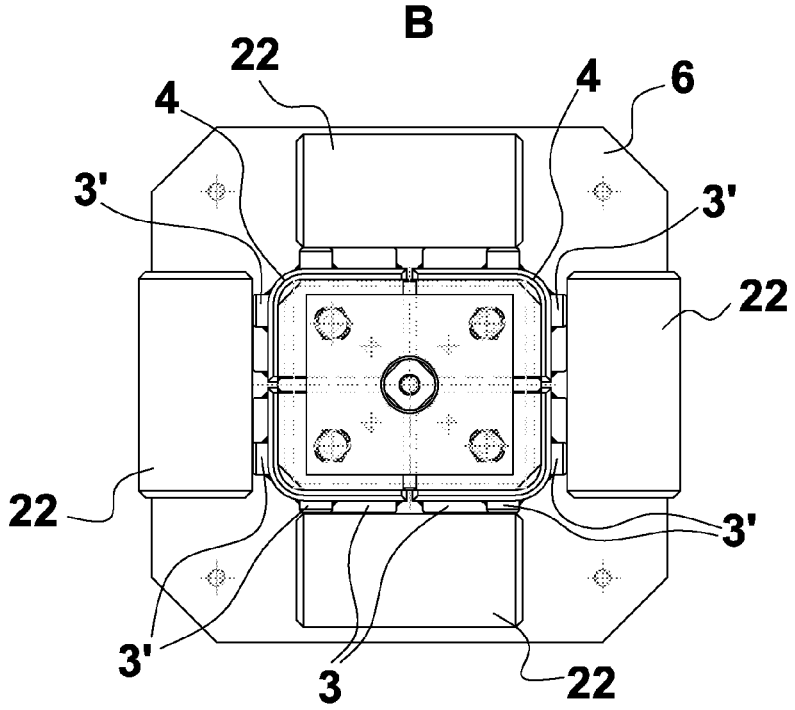
FIG. 5 depicts a bottom view of the template in FIG. 2.

Said longitudinal elements 4 have an L-shaped cross-section, as shown in FIGS. 3 and 4. The longitudinal elements 4 have a longitudinal extension such that a first length covers the whole length of the crystallizer, and a second length covers the zone outside the crystallizer where the rollers 22 are placed at the foot of the ingot mold (shown in the view in FIG. 5), when template 1 is inserted into the crystallizer. At its upper end, template 1 is provided with at least one flange 6 resting on the upper part of the ingot mold.

Figure 2:
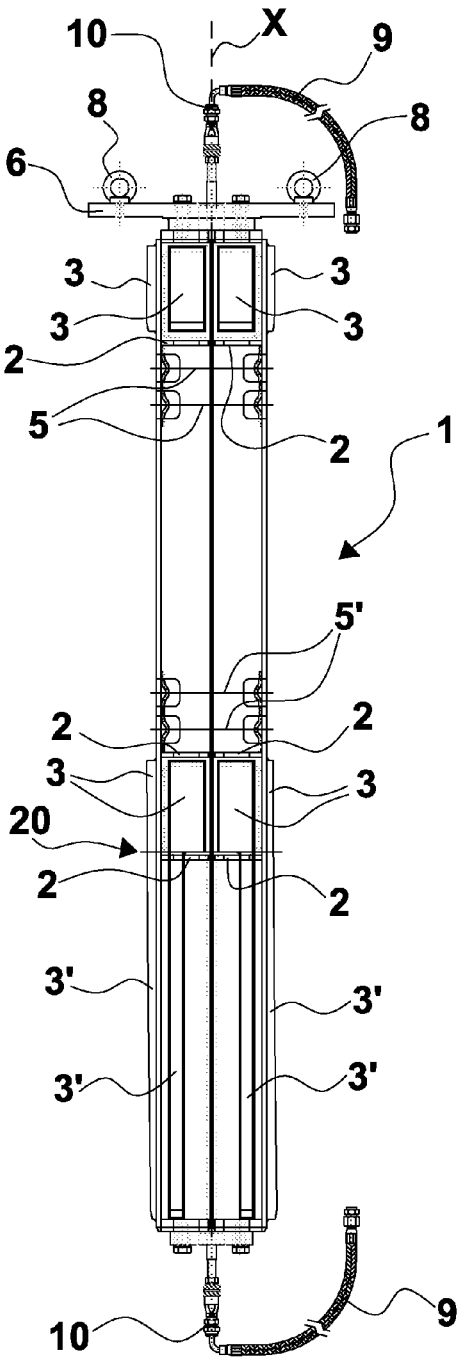
FIG. 2 depicts a first partially cut-out side view of a centering template according to the invention.

The template of the invention is advantageously internally provided with expansible means, preferably comprising two air chambers (FIG. 3). A first air chamber 7 is arranged at the upper end of the template and, therefore, at the upper end of the crystallizer within which the template is placed. On the other hand, a second air chamber 7' is arranged in an intermediate position between the upper and lower ends of the template, advantageously at the lower end of the crystallizer. The line 20 in FIG. 2 shows, for example, the height corresponding to the lower end of the crystallizer when the template is inserted therein. Therefore, the part of template below line 20 remains outside the crystallizer.

These air chambers 7, 7' are arranged in suitable spaces or housings within the template 1, said housings being defined by plates 2 fixed to the longitudinal elements 4. In particular, for each air chamber two plates 2 are provided, orthogonally secured to the inner surface of each longitudinal element or tile 4. Therefore, each air chamber housing is defined by eight plates 2.

Within these spaces, the air chamber may possibly be secured by means of a suitable adhesive or appropriate suction cups to the inner surfaces of the template 1, i.e. to the inner surfaces of the tiles 4.

In the upper and lower parts of the template 1, respective hoses 9 and quick fittings 10 are provided for inputting air or other suitable fluid under pressure into the air chambers 7, 7'.

At each air chamber housing there are advantageously provided, on the outer surface of each longitudinal element 4, striking planes 3 having an outer surface which is accurately machined in order to be suitable for perfectly adhering to the corresponding inner wall portions of the crystallizer. In the embodiment shown in Figures from 2 to 7, for each tile 4 and at each air chamber housing, there are provided two striking planes 3, one for each arm of the L-shape of the tile.

Therefore, once the compressed air is inputted into the chambers 7, 7', these expand by biasing the tiles 4 to a perfect contact of the striking planes 3 with the inner wall of the crystallizer. Thereby, the template stiffens by adhering to the inner shape of the crystallizer, thus providing the part protruding outwards with respect to the crystallizer with an accurate striker on which all the rollers at the foot may be adjusted, both the intrados and extrados rollers and the side rollers.

A further advantage of the template, object of the present invention, is that, in proximity of the housings of air chambers 7, 7', there are provided respective return springs 5, 5' suitable for facilitating the extraction of the template 1 from the crystallizer once the centering of the rollers at the foot of the ingot mold has been performed and the air chambers are deflated. As shown in the cross-sections in FIGS. 6 and 7, each return spring 5, 5' of the tiles, which is arranged on a plane substantially parallel to the plates 2, is secured at its own ends at the vertexes of the L-shape of two opposite tiles 4.

Figure 6:
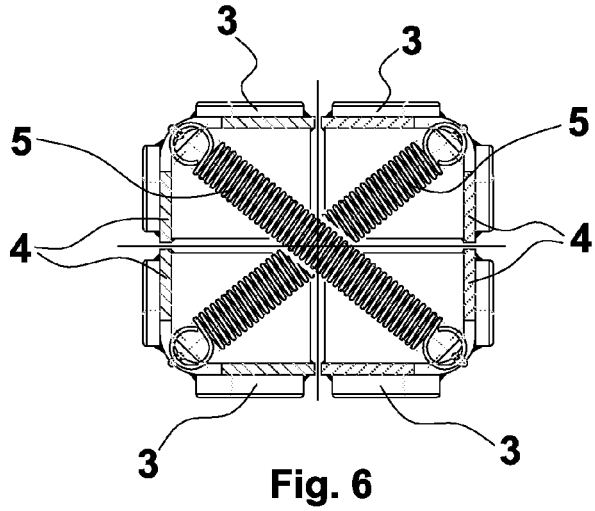
FIG. 6 depicts a sectional view along plane C-C of the template in FIG. 2.
Figure 7:
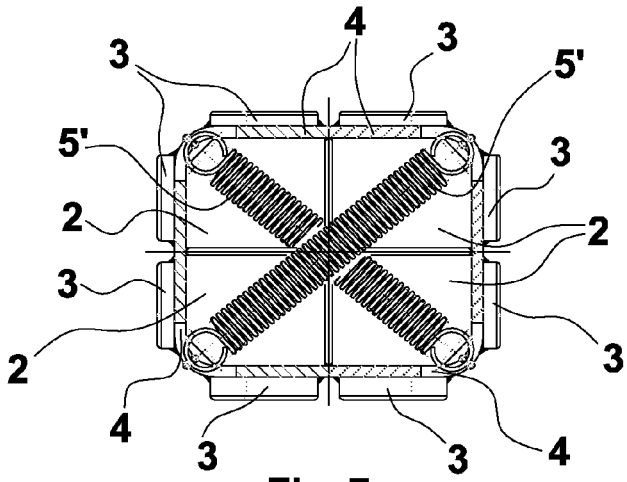
FIG. 7 depicts a sectional view along plane C'-C' of the template in FIG. 2.

A first pair of return springs 5, reciprocally crossed as seen in FIG. 6, is arranged below the housing of the first air chamber 7. A second pair of return springs 5', reciprocally crossed as seen in FIG. 7, is arranged over the housing of the second air chamber 7'.

By deflating the air chambers, the so arranged return springs 5, 5' move the tiles 4 reciprocally closer, thus avoiding any contact and slip of the template with the inner walls of the crystallizer while the template is extracted from the crystallizer itself.

In the portion of template remaining outside the crystallizer, once inserted into the latter, i.e. into the template zone where the adjustment of the rollers at the foot of the ingot mold is made, the longitudinal elements 4 are advantageously provided with longitudinal protrusions 3', which substantially extend along the whole longitudinal extension of said template portion.

Said longitudinal protrusions 3' have the outer surface accurately machined in order to provide an accurate striking plane for aligning the respective rollers at the foot on the template, when the air chambers are inflated up to a perfect contact of the striking planes with the inner wall of the crystallizer.

In the embodiment shown in Figures from 2 to 5, for each tile 4 there are provided two longitudinal protrusions 3', one for each arm of the L-shape of the tile. These protrusions 3' are advantageously provided close to the vertex of the L-shape of the tile 4 and allow to easily and quickly place the rollers at the foot of the ingot mold. In fact, once the air chambers are inflated and the contact between the striking planes 3 and the inner part of the crystallizer is achieved, the rollers at the foot 22 are brought into contact with said longitudinal protrusions 3' and then secured in such a position.

In particular, the generatrix of a roller 22 is brought into contact with the two longitudinal protrusions 3' existing on the side of the template facing said roller.

The longitudinal protrusions 3' may be welded to the tiles 4 or integrally made therewith. The same may also happen for the striking planes 3.

This first embodiment, shown in Figures from 2 to 7, is suitable for square- or rectangular-section crystallizers.

Figure 8:
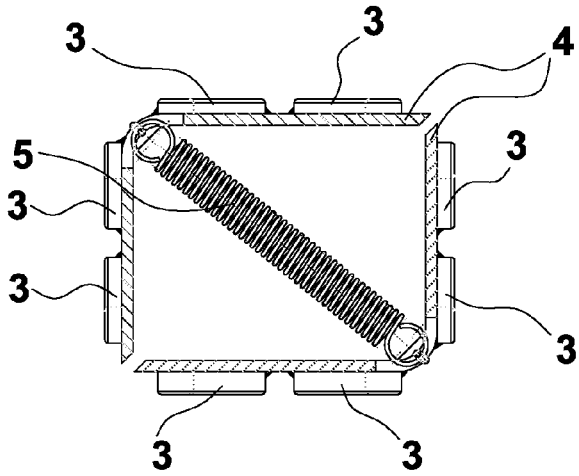
FIG. 8 depicts a sectional view along a transversal plane of a further embodiment of the template of the invention.

A second embodiment of the template of the invention, also suitable for quadrangular-section crystallizers, is provided with two reciprocally distinct and opposite longitudinal elements or tiles 4, in contrast with the first embodiment. Said longitudinal elements 4 have an L-shaped cross-section, as illustrated in the section shown in FIG. 8. In this case, the longitudinal elements 4 are connected to one another by means of a return spring 5, 5', which is substantially arranged on a plane close to each air chamber housing and secured at its own ends at the vertexes of the L-shape of the two opposite tiles 4.

In this second embodiment (FIG. 8), for each tile 4 and at each air chamber housing, four striking planes 3 are provided, two for each arm of the L-shape of the tile 4. Alternatively, for each tile and at each air chamber housing, two striking planes of a longer extension may be provided, one for each arm of the L-shape of the tile. Furthermore, for each tile 4, two longitudinal protrusions are provided, two for each arm of the L-shape of the tile. These protrusions are advantageously provided close to the ends of every arm and allow to easily and quickly place the rollers at the foot of the ingot mold.

Another variant (not shown) of the template of the invention may include two distinct, opposite longitudinal elements, having a substantially U-shaped cross-section and being connected to each other by means of a return spring which is substantially arranged on a plane close to each air chamber housing and constrained at the ends on the bottom of the U-shaped section.

A further variant (not shown) may include four longitudinal elements which are linear, distinct and parallelly opposed in pairs. Each pair of opposite longitudinal elements is provided with at least one return spring arranged on a plane close to each air chamber housing. If there are provided two air chambers, as described for the first embodiment, there will thus be two pairs of return springs: a first pair of return springs, reciprocally crossed and defining reciprocally perpendicular axes when observed in cross-section, is arranged below the housing of the first air chamber; a second pair of return springs, reciprocally crossed and defining reciprocally perpendicular axes when observed in cross-section, is arranged over the housing of the second air chamber.

On the other hand, a third embodiment (not shown) includes a template for centering the rollers at the foot of an ingot mold suitable for casting round-section products. Such a template has at least two longitudinal elements or tiles having a circumference arc-shaped cross-section, i.e. coupled with the round-section of the crystallizer.

At least two air chambers are provided to be housed within the template at the upper and lower ends of the crystallizer, respectively, in which the template itself is inserted, in a similar manner to that described in the first embodiment. This third embodiment may also include the tiles provided with suitable striking planes and longitudinal protrusions serving the same functions and the same advantages described above.

This third embodiment may also include return springs in order to facilitate the extraction of the template from the crystallizer.

Other similar embodiments of the template of the invention may be provided according to the different section of the crystallizer used for casting.

Alternatively, a good centering of the rollers may also be achieved by using a template internally provided with only one air chamber at least partially covering the longitudinal extension of the length of template which is kept within the crystallizer.

A further aspect of the present invention provides for a method for centering the rollers at the foot of the ingot mold by using the afore-mentioned template. Such a method comprises:

- inserting the centering template 1 into the crystallizer until resting said at least one flange 6 on the upper part of the ingot mold;
- inputting air, or other suitable fluid, at a predetermined pressure, through the quick fittings 10 into the air chambers 7, 7' so that the latter expand until the striking planes 3 contact the inner walls of the crystallizer 2, thus making a perfect alignment of the template with said inner walls;
- centering the rollers at the foot by means of moving the rollers themselves reciprocally closer until reaching a position of first contact of the rollers, along one generatrix thereof, with the respective longitudinal protrusions 3';
- locking the rollers in this first contact position.

Once this simple, quick and accurate operation of centering the rollers is completed, the air chambers are deflated by opening the quick fittings 10, thus making the tiles 4 move away from the inner walls of the crystallizer, also by virtue of the return force exerted by the return springs 5, 5'.

Then, the whole centering template 1 is extracted from the crystallizer by means of suitable extracting means which grip on hooks 8 provided in the upper part of the template 1, thus advantageously avoiding frictions and rubbings between the tiles 4 and the already centered rollers 22 which could move said rollers from the achieved position of perfect centering.

The afore-mentioned extracting means also serve the function of inserting the template into the ingot mold.

The invention claimed is:

1. A template for centering rollers at the foot of an ingot mold, the ingot mold being provided with a crystallizer in which the template may be inserted by passing therethrough from a first end to a second end, the template defining a longitudinal axis (X) and comprising:

at least two longitudinal elements separated from each other, having an outer surface of a shape substantially complementary with respective inner wall portions of the crystallizer, wherein the at least two longitudinal elements have a longitudinal extension such that a first length is adapted to cover the whole length of the crystallizer when the template is inserted in the crystallizer, and a second length is adapted to cover a zone outside the crystallizer where the rollers are placed, in that at least one air chamber is housed inside the template and at least partially covers the longitudinal extension of a length of template adapted to remain inside the crystallizer when the template is inserted into said crystallizer, said at least one air chamber being adapted to expand so as to adhere said longitudinal elements to said respective wall portions.

2. A template according to claim 1, wherein there are provided first and second air chambers housed in positions corresponding to the first end and to the second end of the crystallizer, respectively, when the template is inserted into said crystallizer.

3. A template according to claim 2, wherein the air chambers are arranged in appropriate housings inside the template defined by plates secured to the longitudinal elements.

4. A template according to claim 3, wherein at each housing of the air chambers, on the outer surface of each longitudinal element, there are provided striking planes having an outer surface accurately machined in order to perfectly adhere to the corresponding inner wall portions of the crystallizer.

5. A template according to claim 4, wherein close to each housing, at least one respective return spring is provided, which is suitable for facilitating the extraction of the template from the crystallizer once the centering of the rollers at the foot of the ingot mold has been performed and the air chambers are deflated.

6. A template according to claim 5, wherein a first pair of reciprocally crossed return springs is provided to be arranged below the housing of a first air chamber, and wherein a second pair of reciprocally crossed return springs (5') is provided to be arranged over the housing of a second air chamber.

7. A template according to claim 6, wherein the longitudinal elements are provided with longitudinal protrusions which substantially extend along the whole longitudinal extension of said second length.

8. A template according to claim 7, wherein said longitudinal protrusions have the outer surface accurately machined in order to provide an accurate striking plane for aligning on the template the respective rollers at the foot.

9. A template according to claim 7, wherein the longitudinal protrusions and the striking planes may be welded to the longitudinal elements or integrally made therewith.

10. A template according to claim 1, wherein the at least two longitudinal elements and have an L-shaped cross-section.

11. A template according to claim 10, wherein the longitudinal elements are at least four in number, and wherein for each longitudinal element and at each air chamber housing there are provided two striking members, one for each arm of the L-shape; and wherein for each longitudinal element there are provided two longitudinal protrusions, one for each arm of the L-shape, close to the vertex of said L-shape.

12. A template according to claim 1, wherein the at least two longitudinal elements have a circumference arc-shaped cross-section.

13. A method for centering rollers at the foot of an ingot mold provided with a crystallizer, by using a template according to any one of the preceding claims, comprising the following steps:

a) inserting the template into the crystallizer;

b) expanding the at least one air chamber, whereby a contact is made between the longitudinal elements of the template and the inner walls of the crystallizer;

c) centering the rollers at the foot by approaching the rollers until reaching a position of first contact of said rollers along one generatrix thereof with said longitudinal elements.

14. A method according to claim 13, wherein step b) provides for inputting a fluid at a predetermined pressure in the at least one air chamber so that the latter expands until producing said contact of the longitudinal elements of the template with the inner walls of the crystallizer.

15. A method according to claim 13, wherein step c) is completed by locking the rollers in said position of first contact, and in step a) the template is inserted into the crystallizer until resting at least one of its flanges on an upper part of the ingot mold.

* * * * *